US007422117B2

(12) United States Patent
Myatt

(10) Patent No.: US 7,422,117 B2
(45) Date of Patent: Sep. 9, 2008

(54) CONTINUOUS CHANGE ORDER PROCESSING

(75) Inventor: Barbara Myatt, Irving, TX (US)

(73) Assignee: Currency Systems International, Inc., Irving, TX (US)

( * ) Notice: Subject to any disclaimer, the term of this patent is extended or adjusted under 35 U.S.C. 154(b) by 0 days.

(21) Appl. No.: 10/176,745

(22) Filed: Jun. 21, 2002

(65) Prior Publication Data

US 2003/0236589 A1 Dec. 25, 2003

(51) Int. Cl.
*G07F 7/04* (2006.01)

(52) U.S. Cl. ..... 209/534; 194/206

(58) Field of Classification Search ..... 209/534; 194/206, 207; 902/12–16
See application file for complete search history.

(56) References Cited

U.S. PATENT DOCUMENTS

| | | | |
|---|---|---|---|
| 3,222,057 | A | 12/1965 | Couri |
| 3,304,080 | A | 2/1967 | Greenblott et al. |
| 3,759,382 | A | 9/1973 | Walkley et al. |
| 3,932,272 | A | 1/1976 | Carnes, Jr. et al. |
| 4,025,420 | A | 5/1977 | Horino |
| 4,264,808 | A | 4/1981 | Owens et al. |
| 4,357,528 | A | 11/1982 | Smith et al. |
| 4,465,192 | A | 8/1984 | Ohba et al. |
| 4,677,682 | A | 6/1987 | Miyagawa et al. |
| 4,845,917 | A | 7/1989 | Omura et al. |
| 4,905,839 | A | 3/1990 | Yuge et al. |
| 4,905,840 | A | 3/1990 | Yuge et al. |
| 5,012,932 | A | 5/1991 | Omura et al. |
| 5,022,531 | A | 6/1991 | Horino et al. |
| 5,105,364 | A | 4/1992 | Kawamura et al. |
| 5,247,159 | A | 9/1993 | Yuge et al. |
| 5,478,992 | A | 12/1995 | Hamada et al. |
| 5,692,067 | A | 11/1997 | Raterman et al. |
| 5,917,930 | A | 6/1999 | Kayani et al. |

*Primary Examiner*—Joseph C Rodriguez
(74) *Attorney, Agent, or Firm*—Carstens & Cahoon LLP

(57) ABSTRACT

A currency processing machine and method, system, and computer program product for filling change orders is provided. In one embodiment, the currency processing machine includes a document input which receives a stack of documents and feeds single documents from the stack of documents into the document processing machine. The currency processing machine also includes an information collection system collects identifying information about the documents, sorting bins for receiving the documents, a sorter; and a data processing system. The data processing system receives information regarding the quantity of each of several denominations needed by a customer for a change order and dynamically dedicates at least one of the sorting bins for use for filling the change order. The data processing system instructs the sorter to deliver specified quantities of notes of specified denominations to the sorting bins designated for use for filling the change order.

3 Claims, 5 Drawing Sheets

CONTINUOUS CHANGE ORDER PROCESSING

BACKGROUND OF THE INVENTION

1. Technical Field

The field of this invention relates to high-volume currency processing using currency processing machines.

2. Description of the Related Art

Automated, high-volume currency processing is a growing international industry affecting numerous aspects of the distribution, collection, and accounting of paper currency. Currency processing presents unique labor task issues that are intertwined with security considerations. Currency processing requires numerous individual tasks, for example: the collection of single notes by a cashier or bank teller, the accounting of individual commercial deposits or bank teller pay-in accounts, the assimilation and shipment of individual deposits or accounts to a central processing facility, the handling and accounting of a currency shipment after it arrives at a processing facility, and the processing of individual accounts through automated processing machines. Any step in the process that can be automated, thereby eliminating the need for a human labor task, saves both the labor requirements for processing currency and increases the security of the entire process. Security is increased when instituting automated processes by eliminating opportunities for theft, inadvertent loss, or mishandling of currency and increasing accounting accuracy.

A highly automated, high-volume processing system is essential to numerous levels of currency distribution and collection networks. Several designs of high-volume processing machines are available in the prior art and used by such varied interests as national central banks, independent currency transporting companies, currency printing facilities, and individual banks. In general, currency processing machines utilize a conveyer system which transports individual notes past a series of detectors. By way of example, a note may be passed through a series of electrical transducers designed to measure the note's width, length, and thickness. The next set of sensors could be optical sensors recording the note's color patterns. Detectors can likewise be used to detect specific magnetic or other physical characteristics of individual notes.

High volume currency processing machines typically pull individual notes from a stack of currency through a mechanical conveyer past several different detectors in order to facilitate the sorting of the individual notes and the accumulation of data regarding each note fed through the machine. For example, a currency processing machine can perform the simple tasks of processing a stack of currency in order to ensure that it is all of one denomination with proper fitness characteristics while simultaneously counting the stack to confirm a previous accounting. A slightly more complex task of separating a stack of currency into individual denominations while simultaneously counting the currency can be accomplished as well. On the more complex end of prior art currency processing machines, a stack of currency consisting of various denominations can be fed into the machine for a processing that results in the separation of each denomination, a rejection of any currency that does not meet fitness specifications, the identification of counterfeit bills, and the tracking of individual notes by serial number.

Older prior art high-volume currency processing machines are loaded with one single stack of currency, identified to a single set of accounting parameters, before executing the sort process. For example, a stack of currency associated with a specific commercial deposit at a bank may be loaded at the beginning of the currency processing cycle. The currency is then fed into the currency processing machine and sorted based on the needs of the customer. Data obtained from the sort process, for example the number of each denomination note that was detected during the procedure and the total deposit amount, is then compared to the same data identified to the stack of currency prior to the processing cycle. However, a newer prior art currency processing methods have become available that reduces the labor involved in loading the currency processing machine and improves the security involved in this step. Specifically, these currency processing methods process numerous stacks of currency identified to individual accounting parameters one after another without having to wait to reload or stop the machine in order review data collected on each individual account.

However, in addition to sorting numerous stacks of currency to individual accounting parameters, a need exists to process change orders as well. A change order is an order for a certain number of various denominations of currency needed by a bank customer. For example, a store may send an order for twenty-five $1.00 notes, fifty $5.00 notes, fifty $10.00 notes, and one hundred $20.00 notes. These represent the currency denominations and amounts the store needs to conduct operations for the day. However, each customer has different requirements and, furthermore, each customer's requirements may change from day to day. Therefore, a predetermined routine for filling change orders cannot be used. Because the requirements for different customers are different and because requirements change from day to day, prior art currency processing machines are incapable of filling these change orders which resulted in the change orders being filled manually. Therefore, a need exists for an improved currency processing machine and methods capable of filling change orders automatically with minimal use of manual labor.

SUMMARY OF THE INVENTION

The present invention provides a currency processing machine and method, system, and computer program product for filling change orders. In one embodiment, the currency processing machine includes a document input which receives a stack of documents and feeds single documents from the stack of documents into the document processing machine. The currency processing machine also includes an information collection system collects identifying information about the documents, sorting bins for receiving the documents, a sorter; and a data processing system. The data processing system receives information regarding the quantity of each of several denominations needed by a customer for a change order and dynamically dedicates at least one of the sorting bins for use for filling the change order. The data processing system instructs the sorter to deliver specified quantities of notes of specified denominations to the sorting bins designated for use for filling the change order.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 1:
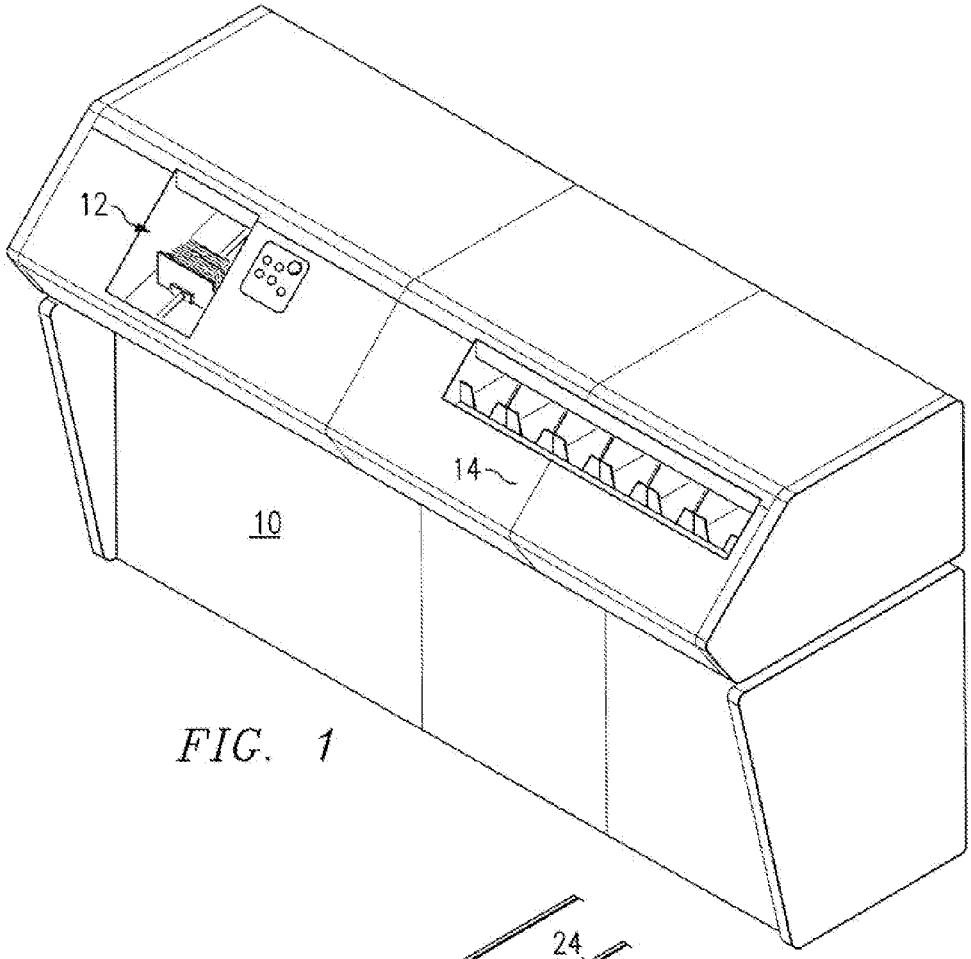
FIG. 1 is a perspective view of a currency processing machine loaded with a stack of currency and separator cards.

FIG. 1 shows a currency processing machine 10 embodying the present invention and loaded with a batch feed of currency 12 prior to starting the currency processing cycle. This batch feed of currency 12 is fed into the currency processing machine one single note at a time. Single notes then travel on a conveyer past several different detectors before being deposited in one of the sort bins 14. Typically, a single sort bin is used to accumulate a single denomination of note at the end of the sort process.

Figure 2:
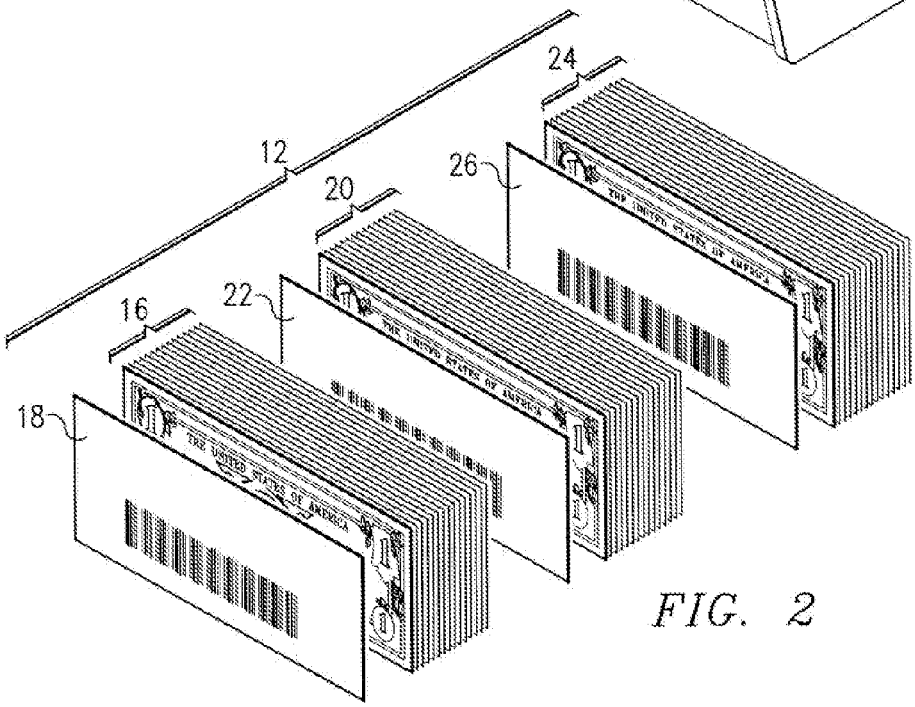
FIG. 2 is a perspective view of a stack of currency divided by separator cards.

FIG. 2 shows a currency batch 12 having several individual currency stacks. The currency batch 12 illustrated consists of a first stack of currency 16, a second stack of currency 20, and a third stack of currency 24. Each stack of currency is accompanied with a separator card 18, 22, 26. In this embodiment, the separator cards 18, 22, 26 are shown as header cards where a first separator card 18 is stacked on top of the first stack of currency 16 and would identify the first stack of currency 16 during the currency processing cycle. Likewise, a second separator card 22 is stacked on top of a second stack of currency 20 and identifies the second stack of currency during the currency processing cycle. It is understood that the present invention contemplates that numerous currency stacks 16, 20, 24 such as the three depicted can be successively stacked to form a large batch feed 12 prior to insertion in the currency processing machine 10. It is also understood that an alternative embodiment from that depicted in FIG. 2 could use separator cards 18, 22, 26 at the end of each stack of currency 16, 20, 24, called trailer cards. A third embodiment could use both header cards and trailer cards to separate the currency stacks 16, 20, 24.

Figure 3A:
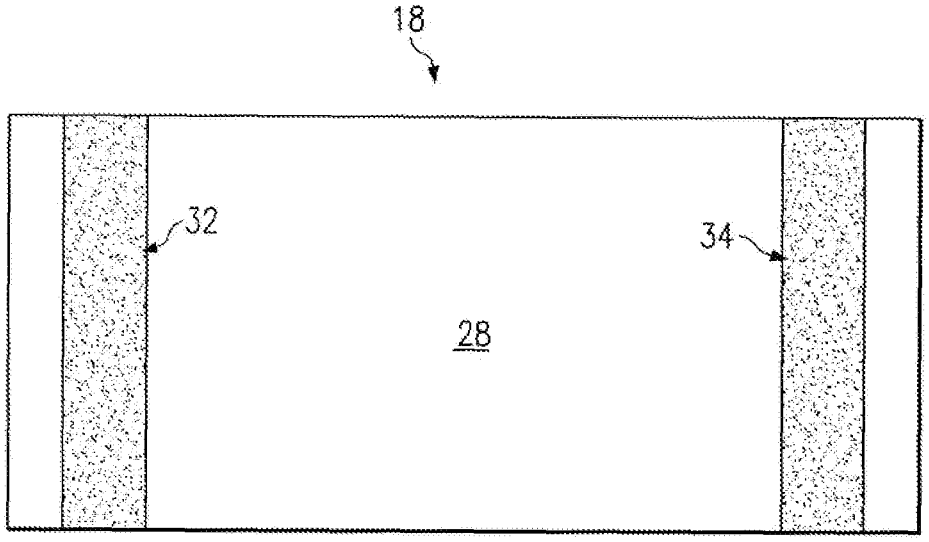
FIG. 3A is a perspective view of the front of an exemplar separator card.
Figure 3B:
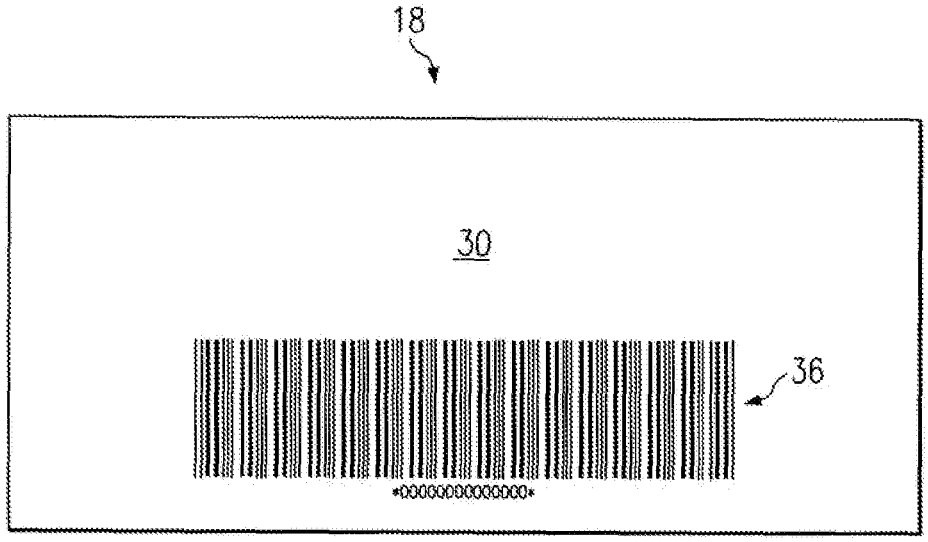
FIG. 3B is a perspective view of the back of an exemplar separator card.

FIGS. 3A and 3B depict an exemplar separator card 18 of the present invention. FIG. 3A shows the first side 28 of the separator card 18, while FIG. 3B shows the second side 30 of the separator card 18. In the embodiment shown by FIGS. 3A and 3B, the first side 28 is overlaid with a first magnetic strip 32 and a second magnetic strip 34. The second side 30 is imprinted with a bar code 36. As will be described in more detail below, this embodiment allows for accurate identification of a separator card 18 primarily by detection of the two magnetic strips 32, 34, while accounting data on an individual stack of currency can be identified to a specific bar code number encoded on the bar code 36 of the separator card 18.

Figure 4:
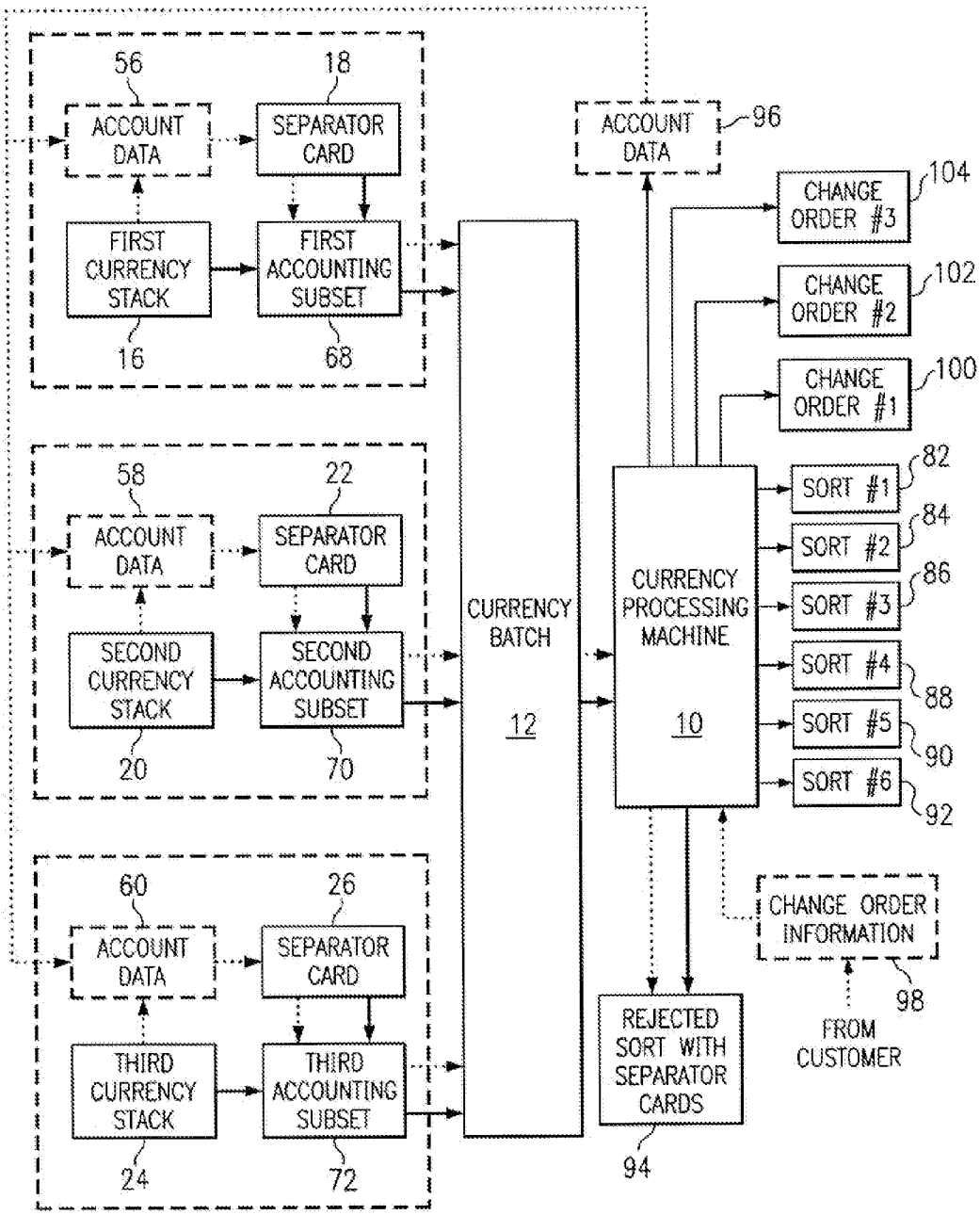
FIG. 4 is a flow cart of a method for processing currency utilizing separator cards and simultaneously filling change orders for bank customers.

FIG. 4 shows a flow chart of a method of processing currency utilizing separator cards and simultaneously filling change orders for bank customers. Using the same exemplar batch of currency 12 shown in FIG. 2, FIG. 4 shows three individual currency stacks 16, 20, 24. Account data 56, 58, 60 associated with each currency stack 16, 20, 24 is first recorded for each account. This account data 56, 58, 60 might include the number of individual currency notes, the total currency value, and the identity of the currency stack to a single commercial deposit or bank teller's shift. The account data 56, 58, 60 is then associated with a separator card 18, 22, 26, which will accompany an individual currency stack 16, 20, 24. This account data can be identified to a separator card by either identifying a bar code number unique to the specific separator card to the account data or by encoding the account data information directly on to the separator card. The physical combination of separator cards 18, 22, 26 and the currency stacks 16, 20, 24 form what is shown as single accounting subsets 68, 70, 72. These accounting subsets 68, 70, 72 can then be stacked into a currency batch 12. This currency batch 12 is fed into a currency processing machine 10.

During the currency processing cycle individual notes from each accounting subset 68, 70, 72 are sorted into sort bins 82, 84, 86, 88, 90, 92, 100, 102, 104. Typically, these sort bins are used to bundle individual denomination notes. For example, the first sort bin 82 may be designated to accumulate $1.00 notes, while the second sort bin 84 may be designated to accumulate $5.00 notes. FIG. 4 shows a separate bin 94 for a rejected sort with the separator cards. This rejected sort bin 94 could be designated to hold any counterfeit currency detected during the currency sort process. By depositing the counterfeit currency with the separator cards 18, 22, 26, a quick physical check can be made to determine which single accounting subset 68, 70, 72 is associated with the counterfeit notes found to follow a specific separator card 18, 22, 26.

Additionally, during the currency processing cycle, change orders for various customer's are filled by dedicating a certain sorting bins 100, 102, 104 to individual customers having change orders to be filled. Change order information 98 is received from the bank's customers and sent to the currency processing machine 10. After a currency note has been processed for account information, the currency note is sorted into one of bins 100, 102, 104 to fill a customer's change order requirement. While bin 100 is receiving notes of a first denomination value (e.g., $1.00 notes) as notes of that denomination become available, bin 102 is receiving notes of a second denomination value (e.g., $5.00 notes) and bin 104 is receiving notes of a third denomination value (e.g., $10.00 notes) as notes of the second and third denomination values become available. Notes not needed by any of the change order bins 100, 102, 104 are routed to one of sorting bins 82, 84, 86, 88, 90, 92. Once each change order bin 100, 102, 104 has had its order filled for a current denomination value, the next value of denomination needed to fill the change order for the current customer assigned to a change order bin 100, 102, 104.

Once a change order is complete, an operator may stop the currency processing machine 10 to remove the change order notes. The operator then resumes operation the currency processing machine 10 and the next change order or orders received by change order information 98 is processed. Once all of the account deposits have been processed, a determination of the remaining quantities of denominations needed to complete change orders currently being processed and to complete change orders yet to be processed is made. An operator then retrieves the needed quantities and places them into the input of the currency processing machine 10 and change order filling continues. Other sort bins 82, 84, 86, 88, 90, 92 used for other purposes during account deposit processing may now be used as additional change order bins allowing more change orders to be processed simultaneously.

Returning now to account deposit processing, account data 96 for each accounting subset 68, 70, 72 is accumulated during the currency processing cycle. This account data 96 can then be compared with similar account data 56, 58, 60 which was originally collected for each individual currency stack 16, 20, 24. For example, while processing the first accounting subset 68, the currency processing machine can accumulate information on the number of each denomination of note processed and the total currency value of the notes associated with the first accounting subset 68. This account data 96 accumulated on the first accounting subset 68 can then be compared to the account data 56 associated with the first currency stack 16 prior to the consolidation of the accounting subset 68 70, 72 into the currency batch 12.

Figure 5:
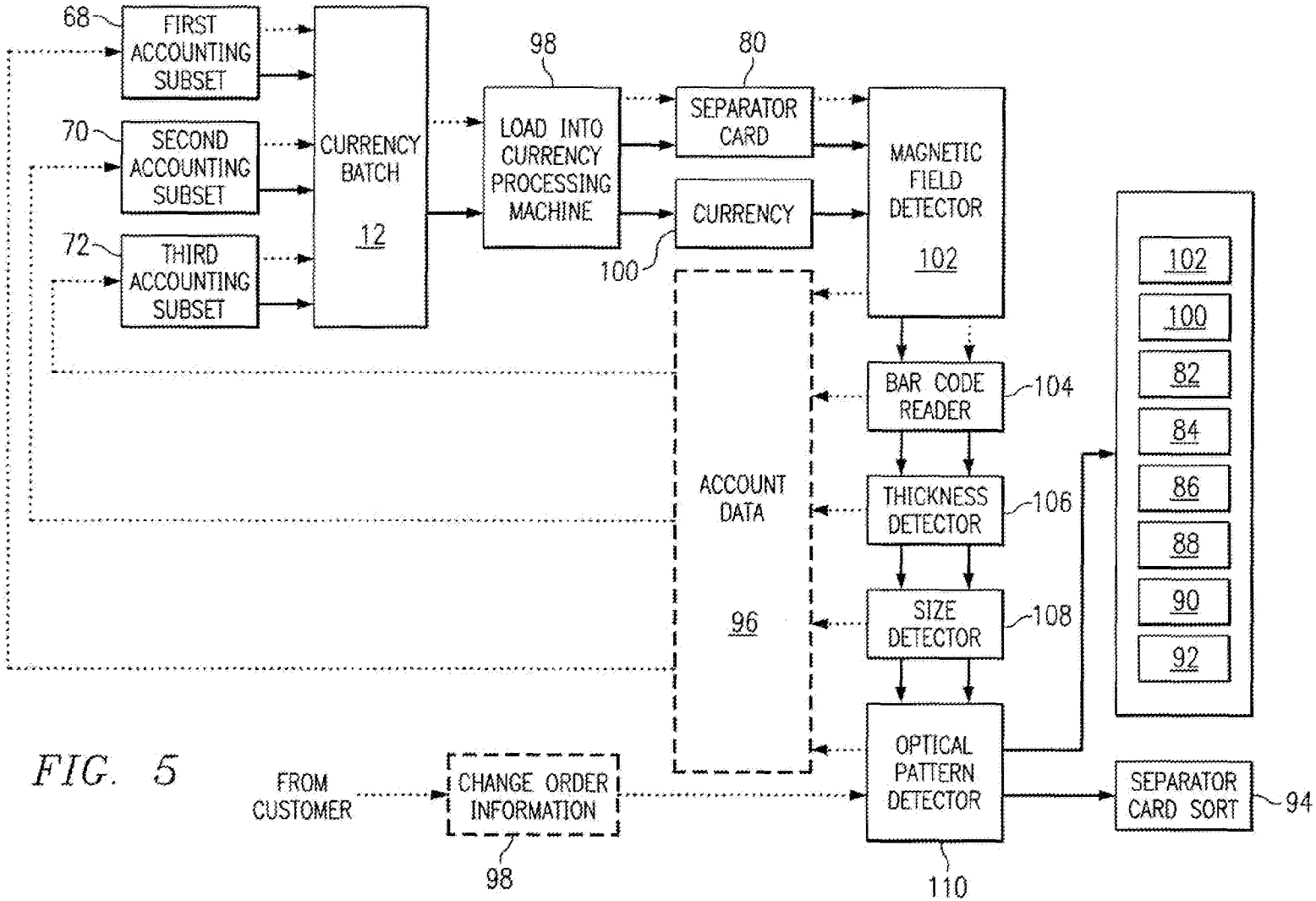
FIG. 5 is a flow chart of a method for identifying separator cards used by currency processing machines and for filling change orders for bank customers.

FIG. 5 shows a flow chart of a method for identifying separator cards used by currency processing machines and a method for filling change orders for bank customers. FIG. 5 starts with the single accounting subset 68, 70, 72, that are likewise shown on FIG. 4. These accounting subsets 68, 70, 72 are stacked to form a currency batch 12. This currency batch is then loaded into the currency processing machine 98. The top item off of the currency batch 12, whether it is a separator card 80 or currency 100, is then pulled into a conveyer past several detectors.

The first detector shown in FIG. 5 is a magnetic field detector 102. This magnetic field detector can detect a unique magnetic strip on a separator card 80 in order to assist the currency processing machine in delineating between separator cards 80 and currency 100. This can be accomplished even in the event of a misfeed which results in a currency note 100 masking other physical features of the separator card 80, since the magnetic field of the separator card 80 can be read through the masking currency 100. The currency processing machine can be designed to read the individual serial number on the note masking what it detects to be a concurrently stacked separator card 80. The information obtained by the magnetic field detector on the separator card, as well as information obtained on the masking note throughout the following detectors, allows for a reconstruction of the misfeed and avoids co-mingling of the accounting subsets 68, 70, 72 during the currency processing cycle.

The next detector depicted in FIG. 5 is a bar code reader 104. This bar code reader identifies the specific bar code number for each individual separator card 80 read. The bar code number is then identified by the currency processing machine with the currency 100 that follows the specific separator card 80. The separator card 80 or currency 100 then passes through one or more detectors designed to measure the thickness and size of the item on the conveyer, as depicted in FIG. 5 by a thickness detector 106 and a size detector 108. This information can be of additional use to the currency processing machine in distinguishing between a separator card 80 and currency 100. The final detector shown on FIG. 5 is an optical pattern detector 110. This optical pattern detector 110 can likewise assist in the process of delineating between a separator card 80 and currency 100, both having unique color characteristics and patterns.

It is understood that the order and type of detectors shown in FIG. 5 represent only one example of a preferred embodiment for the method described. The detectors used in the present invention could be arranged in many different sequences. In addition, other types of detectors can be used to record various characteristics of currency and separator cards.

After passing through the currency processing machine, the currency 100 is deposited in the appropriate sort bin 82, 84, 86, 88, 90, 92 as a part of the currency sort process or in change order bins 100, 102, 104 as part of the change order filling process in response to the change order information 98 received from customers. The separator card, likewise is directed to the separator card sort bin 94.

Account data 96 collected by the currency processing machine on each accounting subset 68, 70, 72 can be compared to similar account data that was associated with the accounting subset 68, 70, 72 prior to the consolidation of these accounts into the currency batch 12. As shown in FIG. 5, the account data 96 collected during the currency processing cycle is assimilated from information provided by the various detectors 102, 104, 106, 108, 110.

The preferred embodiment illustrated in FIG. 5 can additionally detect sequencing errors between separator cards 80 and currency notes 100. For example, when the accounting subsets 68, 70, 72 are comprised of currency stacks separated by header cards, the first item processed through the sequence shown in FIG. 5 should be a separator card 80. The next item processed should be currency 100. If a separator card 80 is detected immediately following the processing of another separator card 80, this event would be identified as a sequencing error which might be traced to improper stacking of the accounting subsets 68, 70, 72. Sequencing errors could likewise be detected when the separator card 80 is a trailer card. The most accurate detection of sequencing errors, however, occurs when the preferred embodiment utilizes both header and trailer cards with each accounting subset 68, 70, 72. The use of both header and trailer cards requires, in sequence, that the first separator card 80 processed for an accounting subset 68, 70, 72 is a header card. The next item processed should be currency 100. The next separator card 80 detected should be a trailer card. A trailer card would then be immediately followed by a header card for the next accounting subset. Any deviations from the above described sequence would, again, indicate a sequencing error that might be attributable to improper stacking of separator cards 80 and currency 100 in the accounting subsets 68, 70, 72.

Figure 6:
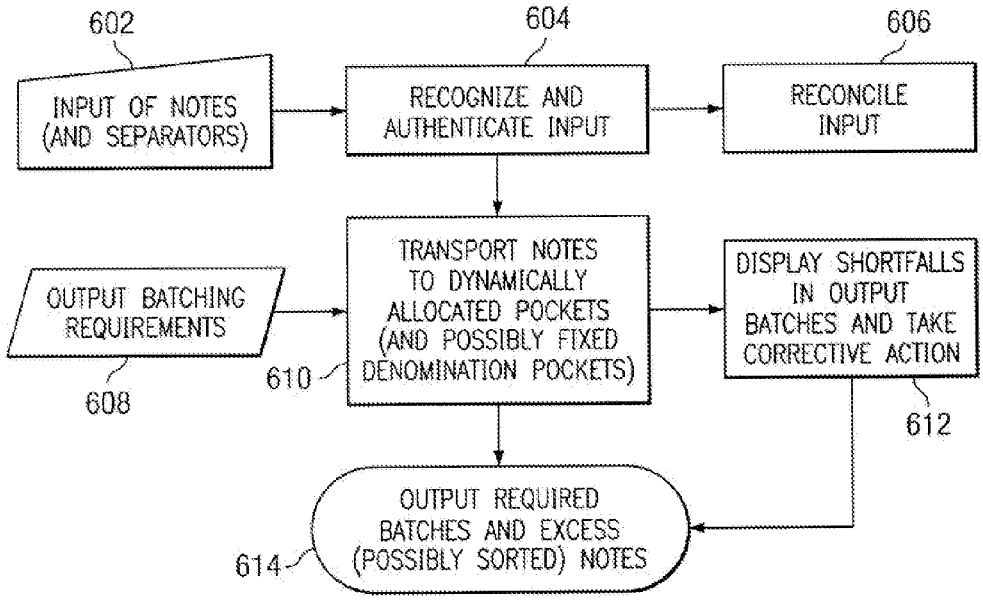
FIG. 6 is a flow chart of a method for filling change orders for bank customers.

FIG. 6 shows a flowchart showing logical steps for processing account deposit information and also fulfilling change order requirements for various customers. Notes and separators are placed in input bin 12 of currency processing machine 10 (step 602). Each note and separator card is recognized and authenticated by the currency processing machine 10 (step 604) and the input reconciled against respective accounts (step 606). Output batching requirements for change orders are received from customers (step 608) and provided to the currency processing machine 10 which uses the information to transport notes to dynamically allocated pockets and, in some embodiments, fixed denomination pockets, such that change orders for the customers are fulfilled (step 610). Shortfalls in output change order batches are displayed to an operator and corrective action is taken either manually by the operator or automatically by the currency processing machine 10 (step 612). Once change orders are filled, an operator collects the output batches for the change orders from the output bins 14 of the currency processing machine 10 as well as collects the excess sorted or unsorted notes.

Figure 7:
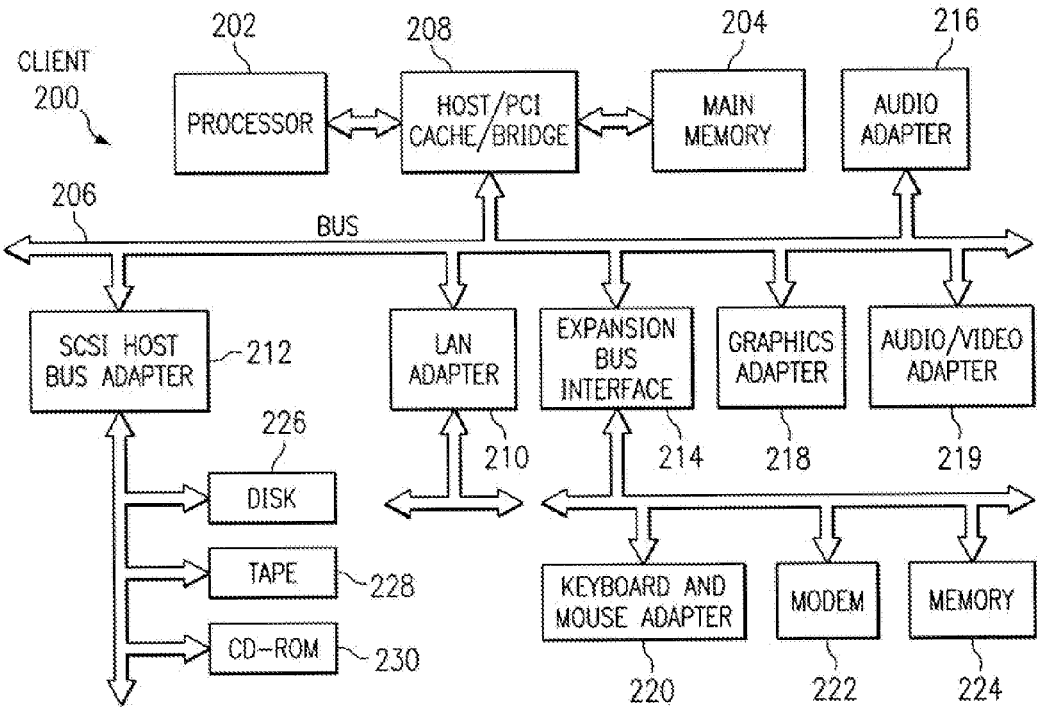
FIG. 7 depicts a block diagram of a data processing system in which the present invention may be implemented.

With reference now to FIG. 7, a block diagram of a data processing system is shown in which the present invention may be implemented. Data processing system 200 is an example of a computer which may be implemented within a currency processing machine such as currency processing machine 10, in which code or instructions implementing the processes of the present invention may be located. Data processing system 200 employs a peripheral component interconnect (PCI) local bus architecture. Although the depicted example employs a PCI bus, other bus architectures such as Accelerated Graphics Port (AGP) and Industry Standard Architecture (ISA) may be used. Processor 202 and main memory 204 are connected to PCI local bus 206 through PCI bridge 208. PCI bridge 208 also may include an integrated memory controller and cache memory for processor 202. Additional connections to PCI local bus 206 may be made through direct component interconnection or through add-in boards. In the depicted example, local area network (LAN) adapter 210, small computer system interface SCSI host bus adapter 212, and expansion bus interface 214 are connected to PCI local bus 206 by direct component connection. In contrast, audio adapter 216, graphics adapter 218, and audio/video adapter 219 are connected to PCI local bus 206 by add-in boards inserted into expansion slots. Expansion bus interface 214 provides a connection for a keyboard and mouse adapter 220, modem 222, and additional memory 224. SCSI host bus adapter 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 2. The operating system may be a commercially available operating system such as Windows XP, which is available from Microsoft Corporation. An object oriented programming system such as Java may run in conjunction with the operating system and provides calls to the operating system from Java programs or applications executing on data processing system 200. "Java" is a trademark of Sun Microsystems, Inc. Instructions for the operating system, the object-oriented programming system, and applications or programs are located on storage devices, such as hard disk drive 226, and may be loaded into main memory 204 for execution by processor 202.

Those of ordinary skill in the art will appreciate that the hardware in FIG. 2 may vary depending on the implementation. Other internal hardware or peripheral devices, such as flash read-only memory (ROM), equivalent nonvolatile memory, or optical disk drives and the like, may be used in addition to or in place of the hardware depicted in FIG. 2. Also, the processes of the present invention may be applied to a multiprocessor data processing system.

For example, data processing system 200, if optionally configured as a network computer, may not include SCSI host bus adapter 212, hard disk drive 226, tape drive 228, and CD-ROM 230. In that case, the computer, to be properly called a client computer, includes some type of network communication interface, such as LAN adapter 210, modem 222, or the like. As another example, data processing system 200 may be a stand-alone system configured to be bootable without relying on some type of network communication interface, whether or not data processing system 200 comprises some type of network communication interface. As a further example, data processing system 200 may be a personal digital assistant (PDA), which is configured with ROM and/or flash ROM to provide non-volatile memory for storing operating system files and/or user-generated data.

The depicted example in FIG. 2 and above-described examples are not meant to imply architectural limitations.

The processes of the present invention are performed by processor 202 using computer implemented instructions, which may be located in a memory such as, for example, main memory 204, memory 224, or in one or more peripheral devices 226-230.

It would be understood that various changes in the details, materials, and arrangements, of the processes which have been described and illustrated in order to explain the nature of the invention, may be made by those skilled in the art within the principle and scope of the invention as expressed in the following claims. For example, the number of sorting bins utilized may be more or less than those depicted in the various examples presented. Furthermore, a larger or smaller percentage of the sorting bins may be dedicated for use in filling change orders than has been depicted herein.

Furthermore, it is important to note that while the present invention has been described in the context of a fully functioning data processing system, those of ordinary skill in the art will appreciate that the processes of the present invention are capable of being distributed in a form of a computer readable medium of instructions and in a variety of forms. Further, the present invention applies equally regardless of the particular type of signal bearing media actually used to carry out the distribution. Examples of computer readable media include recordable-type media such a floppy disc, a hard disk drive, a RAM, a CD-ROM, a DVD-ROM, and transmission-type media such as digital and analog communications links, wired or wireless communications links using transmission forms such as, for example, radio frequency and light wave transmissions. The computer readable media may take the form coded formats that are decoded for actual use in a particular data processing system.

The description of the present invention has been presented for purposes of illustration and description, but is not limited to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated

What is claimed is:

1. A method of semi-continuous processing of currency notes in a currency processing machine to fill change orders, the method comprising:

receiving change order information;

dynamically allocating at least one sorting bin to a customer which has provided a change order;

determining criteria from the change order information related to the quantities and denominations of currency notes to be provided to the at least one sorting bin;

feeding currency notes into the currency processing machine;

sending notes satisfying the criteria to the at least one sorting bin;

reconciling currency notes corresponding to customer accounts fed into the currency processing machine with account information associated with an input currency stack;

responsive to a determination that no more notes corresponding to customer accounts are available for processing, allocating remaining sorting bins not associated with a change order to remaining change orders awaiting fulfillment; and feeding currency notes not corresponding to a customer account into the currency processing machine for processing.

2. A computer program product in a computer readable media for use in a data processing system for controlling semi-continuous processing of currency notes in a currency processing machine to fill change orders, the computer program product comprising:

first instructions for receiving change order information;

second instructions for dynamically allocating at least one sorting bin to a customer which has provided a change order;

third instructions for determining criteria from the change order information related to the quantities and denominations of currency notes to be provided to the at least one sorting bin;

fourth instructions for feeding currency notes into the currency processing machine;

fifth instructions for sending notes satisfying the criteria to the at least one sorting bin;

sixth instructions for reconciling currency notes corresponding to customer accounts fed into the currency processing machine with account information associated with an input currency stack;

seventh instructions, responsive to a determination that no more notes corresponding to customer accounts are available for processing, for allocating remaining sorting bins not associated with a change order to remaining change orders awaiting fulfillment; and eighth instructions for feeding currency notes not corresponding to a customer account into the currency processing machine for processing.

3. A system for controlling semi-continuous processing of currency notes in a currency processing machine to fill change orders, the system comprising:

first means for receiving change order information;

second means for dynamically allocating at least one sorting bin to a customer which has provided a change order;

third means for determining criteria from the change order information related to the quantities and denominations of currency notes to be provided to the at least one sorting bin;

fourth means for feeding currency notes into the currency processing machine;

fifth means for sending notes satisfying the criteria to the at least one sorting bin, wherein fulfillment of the change order occurs concurrently with a currency processing cycle;

sixth means for reconciling currency notes corresponding to customer accounts fed into the currency processing machine with account information associated with an input currency stack;

seventh means, responsive to a determination that no more notes corresponding to customer accounts are available for processing, for allocating remaining sorting bins not associated with a change order to remaining change orders awaiting fulfillment; and eighth means for feeding currency notes not corresponding to a customer account into the currency processing machine for processing.

* * * * *